United States Patent [19]

Horton

[11] Patent Number: 4,460,318

[45] Date of Patent: Jul. 17, 1984

[54] APPARATUS AND METHOD FOR TRANSFERRING SLURRIES

[75] Inventor: Joel R. Horton, Maryville, Tenn.

[73] Assignee: The United States of America as represented by the United States Department of Energy, Washington, D.C.

[21] Appl. No.: 408,092

[22] Filed: Aug. 13, 1982

[51] Int. Cl.[3] ..... F04F 1/02

[52] U.S. Cl. ..... 417/54; 417/103; 417/900

[58] Field of Search ..... 417/101, 102, 103, 900, 417/92, 54, 55; 406/109

[56] References Cited

U.S. PATENT DOCUMENTS

| | | | |
|---|---|---|---|
| 3,891,352 | 6/1975 | Tsukamoto | 417/101 |
| 3,907,462 | 9/1975 | Kroeger | 417/102 |
| 4,304,527 | 12/1981 | Jewell | 417/102 |
| 4,378,183 | 3/1983 | Ackerman | 417/900 X |

*Primary Examiner*—Richard E. Gluck

*Attorney, Agent, or Firm*—Edwin D. Grant; Stephen D. Hamel; Michael F. Esposito

[57] ABSTRACT

Slurry is transferred to a high pressure region by pushing the slurry from the bottom of a transfer vessel with a pressurizing liquid admitted into the top of the vessel. While the pressurizing liquid is being introduced into the transfer vessel, pressurizing liquid which has mixed with slurry is drawn off from the transfer vessel at a point between its upper and lower ends.

8 Claims, 4 Drawing Figures

APPARATUS AND METHOD FOR TRANSFERRING SLURRIES

BACKGROUND OF THE INVENTION

This invention, which resulted from a contract with the United States Department of Energy, relates to the transfer of a fluid by the use of another fluid as a driving force.

Slurries such as those used in coal gasification or liquefaction cause rapid deterioration of pumps used to force the slurries through pipelines. To obviate this problem, such abrasive slurries have been forced through conduits by means of other fluids that are pumped under high pressure into vessels to expel the slurries therefrom. This method of moving a slurry is not always satisfactory, however, because contact between a clean pressurizing liquid and a slurry can dilute the latter and thus adversely affect its properties. In addition, contact between a clean pressurizing liquid and a slurry in a conventional transfer apparatus can finally result in migration of some abrasive particles to pumps in recycled pressurizing liquid, which causes the pumps to deteriorate rapidly.

SUMMARY OF THE INVENTION

It is therefore an object of this invention to provide a more effective apparatus and method for transferring an abrasive fluid by use of another high pressure fluid as a driving force.

Another object of the invention is to reduce the dilution of a slurry that is expelled from a vessel by a high pressure clean liquid.

An additional object of the invention is to minimize the possibility of a pump being damaged by entry of slurry into recycled clean pressurizing liquid in a flow apparatus of the type described.

In accordance with the fluid transfer method disclosed herein, the above objects are accomplished by conducting a first fluid from a first region of low pressure into the lower end of a vessel, terminating the flow of said first fluid into said vessel when its level therein reaches a first point intermediate the upper and lower ends thereof, and introducing a second fluid into the upper end of said vessel to force said first fluid from the lower end of said vessel to a second region having a fluid pressure higher than the fluid pressure of said first region, while simultaneously removing from said vessel, at a point above said first point therein, a mixture of said first and second fluids.

DETAILED DESCRIPTION OF THE PREFERRED APPARATUS AND PROCESS OF THE INVENTION

Figure 1:
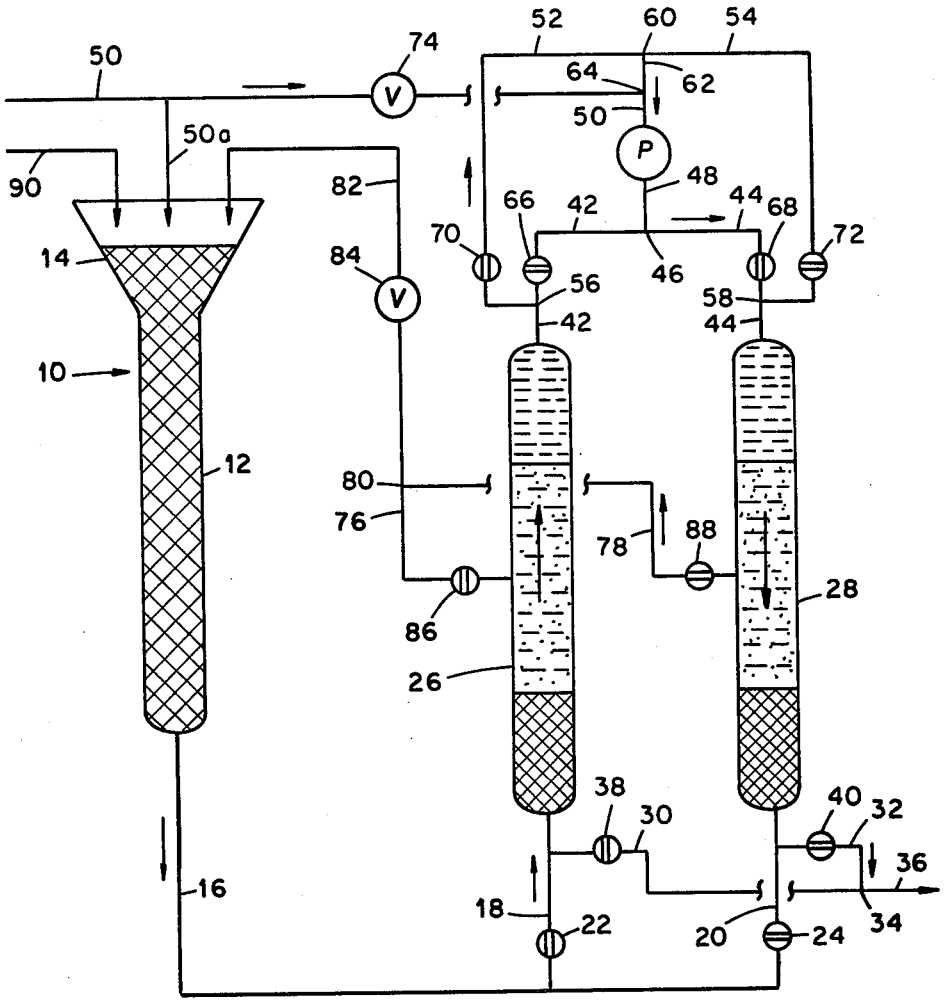
FIGS. 1 through 4 are schematic representations of a fluid transfer apparatus constructed in accordance with the principles of the invention, the drawings illustrating valve settings and the flow of fluid into and out of two vessels of the apparatus during its operation.

In FIG. 1, reference number 10 generally designates a mixing vessel having a cylindrical portion 12 the longitudinal axis of which is vertical and a conical portion 14 secured to the upper end of said portion 12. A conduit 16 communicates with the lower end of vessel 10 and with two input conduits 18,20 each having a valve 22,24 therein. Conduit 18 communicates with the lower end of a first transfer vessel 26, and conduit 20 communicates with the lower end of a second transfer vessel 28. Two output conduits 30,32 are respectively connected to conduits 18,20 below the transfer vessel and unite at point 34 with a conduit 36, these output conduits 30,32 also being provided with valves 38,40, respectively.

The longitudinal axes of vessels 26,28 are vertical, and conduits 42,44 respectively communicate with the upper ends of said vessels and unite at point 46 with a conduit 48 connected to a pump P. Another conduit 50 supplies a clean fluid to pump P and also supplies the same fluid to vessel 10 through a branch conduit 50*a*. Two conduits 52,54 respectively connect with conduits 42,44 at points 56,58 and unite at point 60 with a conduit 62 which in turn connects with conduit 50 at point 64. Valves 66,68 are respectively installed in conduits 42,44 between point 46 and points 56,58, valves 70,72 are respectively installed in conduits 52,54 between point 60 and points 56,58, and a throttle valve 74 is installed in conduit 50 upstream of point 64.

Conduits 76,78 respectively communicate with the interiors of transfer vessels 26,28 intermediate the upper and lower ends thereof and unite at point 80 with a conduit 82 the outlet end of which is located within portion 14 of mixing vessel 10. A throttle valve 84 is located in conduit 82 and valves 86,88 are respectively located in conduits 76,78. Lastly, the outlet end of another conduit 90 is also located within portion 14 of vessel 10.

Operation

In the process embodiment of the invention which will be described, pulverized solids are delivered to mixing vessel 10 through conduit 90 and water is delivered to the mixing vessel through conduits 50 and 50*a*. Mixing of coal particles with water in vessel 10 occurs at atmospheric pressure. As will be further described hereinafter, make-up water also flows through conduit 50 to pump P and alternately through conduits 42,44 into the upper ends of transfer vessels 26,28.

In the operational condition of the apparatus that is illustrated in FIG. 1, valve 22 is open and a slurry of particulates and water flows through conduit 16 into the lower end of transfer vessel 26, this slurry being represented by double crosshatch lines. Situated above the slurry in each vessel 26,28 is a slug of liquid consisting of clean fluid that has entered the upper end of a vessel and particulates that have migrated into this clean fluid from the slurry introduced into the lower end of the vessel, and each of these slugs is represented by an area filled with both dashes and dots. Clean fluid in the vessels is represented by areas filled only with dashes. The arrow in vessel 26 indicates that slurry entering the bottom of the vessel is pushing the slug of clean fluid contaminated with solid material toward the upper end of the vessel. While slurry is entering vessel 26, valve 70 is open and clean water flows from said vessel through conduit 52 to pump P, along with a small amount of clean make-up fluid which flows through conduit 50 and the volume of which can be adjusted by means of throttle valve 74. It will be seen in FIG. 1 that during this operational step valves 66 and 72 are closed and valve 68 is open, so that the output of pump P is fed into the upper end of transfer vessel 28. Valves 38 and 24 are closed and valve 40 is open, and therefore the clean fluid entering the upper end of vessel 28 pushes the slug of contaminated fluid in the vessel downwardly as illustrated by the arrow in vessel 28, and said slug in turn pushes the slurry in the lower end of the vessel through conduits 32 and 36 to a coal liquefaction or gasification reaction vessel (not illustrated) operated under a high pressure. Valve 86 in conduit 76 connected to vessel 26 is closed at this stage of operation, but valve 88 in conduit 78 connected to vessel 28 is open and while the slug of contaminated water in the last-mentioned vessel is being pushed downwardly, a portion of the contaminated fluid flows through conduits 78 and 82 back to mixing vessel 10. The amount of contaminated fluid which flows through conduits 78,80 can of course be controlled by the setting of valve 84.

Figure 2:
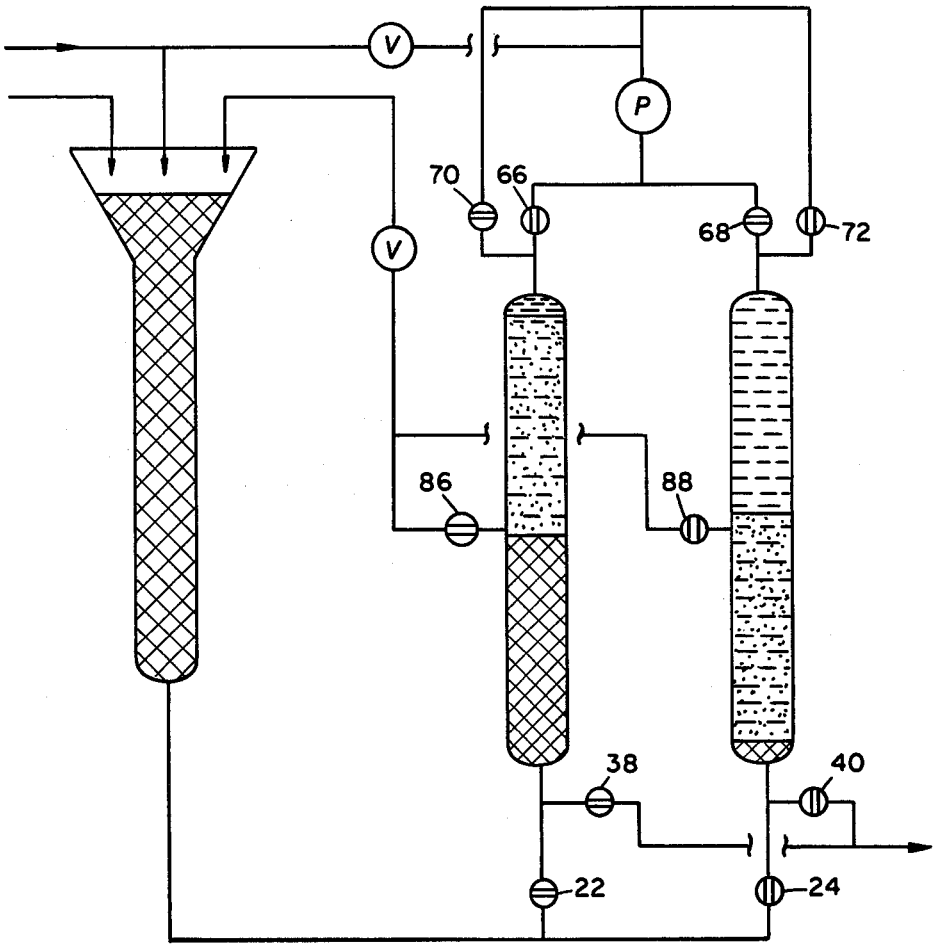
Figure 3:
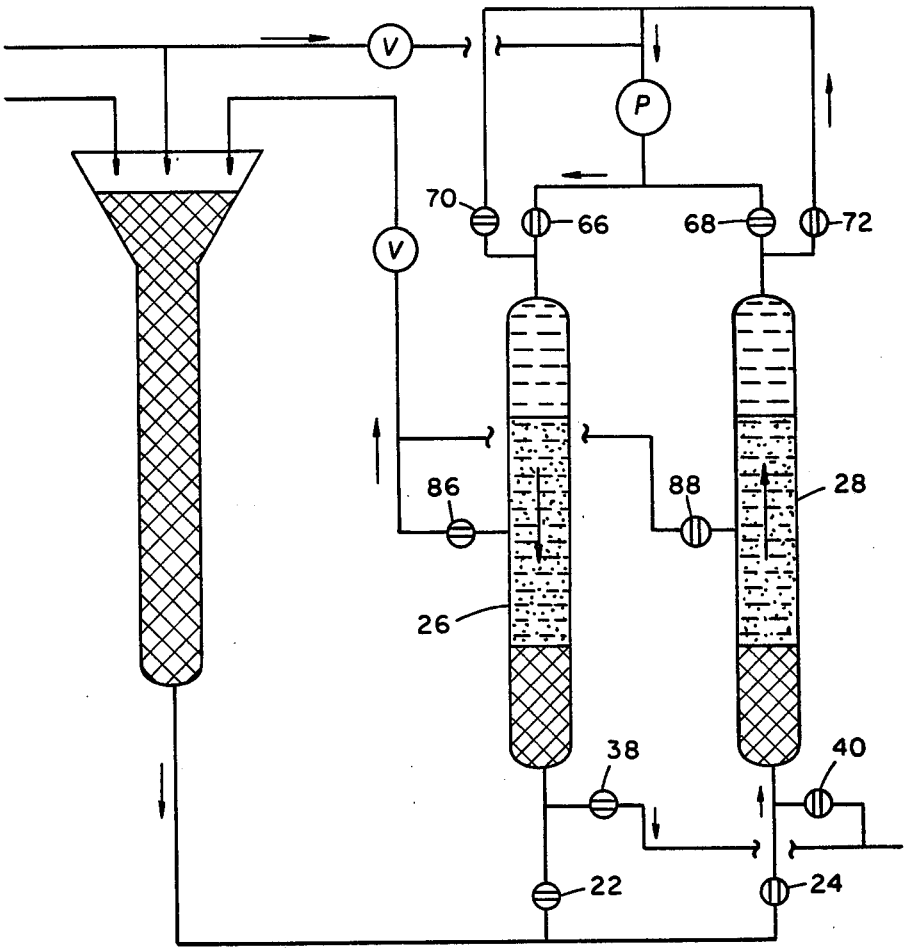

FIG. 2 illustrates the switching of all valves (except the throttle valves 74,84) which occurs when the level of slurry in vessel 26 has risen to a point slightly below the opening for conduit 76 and the level of slurry in vessel 28 has fallen to a point slightly above the opening for conduit 20. More specifically, at this time valve 22 is closed and, simultaneously, valve 24 is opened so that slurry will flow into the lower end of vessel 28. Concurrently, valve 66 is opened and valve 70 is closed, valve 68 is closed and valve 72 is opened, valve 86 is opened and valve 88 is closed, and valve 38 is opened and valve 40 is closed. Thereafter, as illustrated in FIG. 3, slurry entering vessel 28 lifts the slug of contaminated fluid in the vessel and clean fluid flows through conduit 54 to pump P and thence into the upper end of vessel 26 through conduits 48 and 42, pushes the slug of contaminated fluid in vessel 26 downwardly and forces slurry through conduit 30 to the coal liquefaction reaction vessel connected thereto. A small amount of clean make-up fluid is also pumped into vessel 26 from conduit 50 along with the clean fluid from vessel 28, and a portion of the contaminated slug of fluid in vessel 26 is drawn off through conduits 76,82 to mixing vessel 10 while clean fluid is entering vessel 26.

Figure 4:
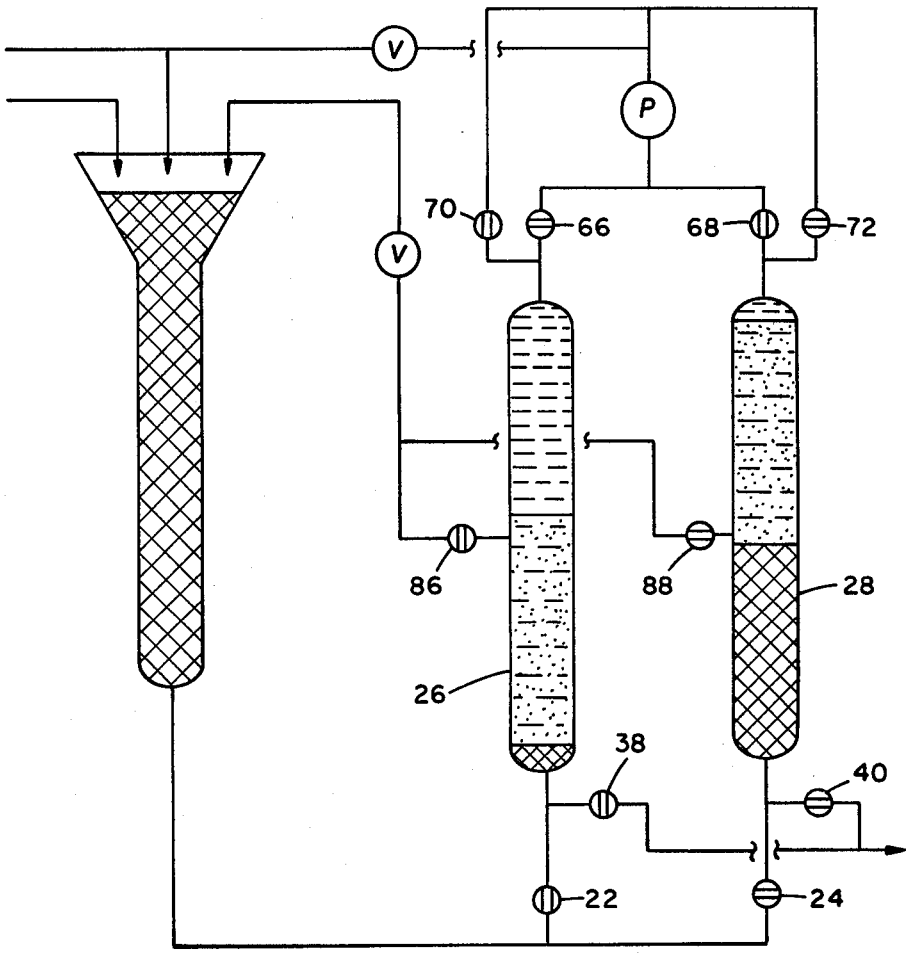

FIG. 4 illustrates the switching of valves which again occurs when the level of slurry in vessel 28 has risen to a point slightly below the opening for conduit 78 and the level of slurry in vessel 26 has fallen to a point slightly above the opening for conduit 18. Flow of liquid streams into and out of vessels 26,28 thereafter ocurs as illustrated in FIG. 1 and the described operational steps are repeated.

By properly adjusting the throttle valves 74,84, the amount of clean make-up water alternately introduced into vessels 26,28 through conduit 50 can be equilibrated with the amount of contaminated water drawn out of the vessels through conduits 76,78. The flow rate of make-up water into vessels 26,28 can also be balanced with the rate of the contamination of clean water with slurry. Hence, an apparatus and process in accordance with the invention precludes a build-up of solids in clean water in the transfer vessels that could result in transfer of abrasive material to pump P.

The principles of the invention can advantageously be applied to transfer of many different materials, for example, cement mixtures, grouting material, drilling mud, and various slurries containing particles of coal or coal ash and other coal derivatives.

What is claimed is:

1. A method of pumping a first liquid from a first region to a second region of higher pressure by a second liquid in a system including a vertically oriented vessel having upper and lower ends, a quantity of said first liquid contained in said lower end of said vessel, a quantity of said second liquid contained in said upper end of said vessel, and a slug of liquid consisting of a mixture of said first and second liquids disposed between said first and second liquids, comprising the cyclic steps of:

conducting an additional amount of said first liquid from said first region into said vessel at the lower end thereof while simultaneously discharging an amount of said second liquid from the upper end of said vessel corresponding to said additional amount of said first liquid conducted into said vessel;

terminating the flow of said first liquid into said vessel when its level reaches a first level intermediate the upper and lower ends thereof and below a discharge port located intermediate said upper and lower ends of said vessel;

introducing said second liquid into the upper end of said vessel at a pressure higher than the pressure in said second region to force a portion of said first liquid from the lower end of said vessel to said second region; and simultaneously discharging a portion of said slug of liquid through said discharge port at a selected rate to maintain a preselected level of said slug of liquid in said vessel, thereby preventing the flow of said first liquid from reaching said upper end of said vessel and said second liquid from reaching said lower end of said vessel.

2. The method of claim 1 wherein said first liquid is a slurry of solid particles in a liquid.

3. The method of claim 2 wherein:

said solid particles are selected from the group consisting of coal and coal derivatives.

4. A method of pumping a first liquid from a first region to a second region of higher pressure by a second liquid in a system including first and second vertically oriented vessels each having upper and lower ends, a quantity of said first liquid contained in said lower end of each of said vessels, a quantity of said second liquid contained in said upper end of each of said vessels and a slug of liquid consisting of a mixture of said first and second liquids disposed within each of said vessels between said first and second liquids, comprising the cyclic steps of:

alternately conducting an additional amount of said first liquid from said first region into said first and second vessels respectively at the lower end of each of said vessels while simultaneously discharging an amount of said second liquid from said upper end of said first and second vessels respectively corresponding to said additional amount of said first liquid conducted into said first and second vessels respectively;

alternately terminating the flow of said first liquid into said first and second vessels respectively when the level reaches a point intermediate the upper and lower ends thereof and below a discharge port located intermediate said upper and lower end of each of said first and second vessels; and alternately introducing said second liquid into the upper end of said first and second vessels at a pressure higher than the pressure in said second region to alternately force a portion of said first liquid from the lower end of each of said first and second vessels to said second region in alternate order with said conducting step while simultaneously discharging a portion of said slug of liquid through the corresponding vessel discharge port at a selected rate to maintain a preselected level of said slug of liquid and each of said first and second vessels, respectively, thereby preventing the flow of said first liquid in each of said vessels from reaching the upper ends thereof and said second liquid in each of said vessels from reaching the lower ends thereof.

5. Apparatus for transferring a first liquid from a first region to a second region of higher pressure by a second liquid, comprising:

at least one vertically oriented vessel having upper and lower ends, said vessel containing a quantity of said first liquid in said lower end thereof, a quantity of said second liquid in the upper end thereof and a slug of liquid consisting of a mixture of said first and second liquids disposed between said first and second liquids;

an input conducting means for conducting said first liquid from said first region into the lower end of said at least one vessel;

an output conducting means for conducting said first liquid from the lower end of said vessel to said second region;

pumping means for introducing said second liquid into the upper end of said vessel at a pressure higher than the pressure of said second region to thereby force the first liquid introduced into said vessel through said output conducting means to said second region;

means associated with said input conducting means for blocking reverse flow of the first liquid therethrough while the second liquid is being introduced into said at least one vessel; and discharge means for cyclically discharging a portion of said slug of liquid at a controlled rate from said at least one vessel at a point between its upper and lower ends while said second liquid is being introduced therein so that the flow of said first liquid is prevented from reaching the upper end of said vessel and the flow of said second liquid is prevented from reaching the lower end of said vessel.

6. The apparatus of claim 5 wherein said at least one vertically oriented vessel includes first and second vertically oriented vessels, said input conducting means includes means for alternately conducting said first liquid from said first region into the lower ends of said first and second vessels, respectively, said output conducting means includes means for alternately conducting said first liquid from the lower ends of said first and second vessels, respectively, to said second region in alternate order with said input conducting means, said pumping means including means for alternately introducing said second liquid into the upper ends of said first and second vessels respectively in alternate order with said input conducting means, and said discharge means including means for alternately discharging a portion of said slug of liquid from said first and second vessels respectively in alternate order with said input conducting means.

7. The apparatus of claim 6 wherein said first liquid is a slurry of solid particles in a liquid.

8. The apparatus of claim 7 wherein said solid particles are selected from the group consisting of coal and coal derivatives.

* * * * *